US011060403B2

(12) United States Patent
Redon

(10) Patent No.: US 11,060,403 B2
(45) Date of Patent: Jul. 13, 2021

(54) PISTON COMBINATIONS FOR OPPOSED-PISTON ENGINES

(71) Applicant: ACHATES POWER, INC., San Diego, CA (US)

(72) Inventor: Fabien G. Redon, San Diego, CA (US)

(73) Assignee: Achates Power, Inc., San Diego, CA (US)

( * ) Notice: Subject to any disclaimer, the term of this patent is extended or adjusted under 35 U.S.C. 154(b) by 0 days.

(21) Appl. No.: 16/445,558

(22) Filed: Jun. 19, 2019

(65) Prior Publication Data

US 2020/0400021 A1 Dec. 24, 2020

(51) Int. Cl.

| | |
|---|---|
| ***F01B 7/14*** | (2006.01) |
| ***F02B 53/02*** | (2006.01) |
| ***F02B 15/00*** | (2006.01) |
| ***F02B 75/24*** | (2006.01) |

(52) U.S. Cl.

CPC ..... *F01B 7/14* (2013.01); *F02B 15/00* (2013.01); *F02B 53/02* (2013.01); *F02B 75/24* (2013.01)

(58) Field of Classification Search

CPC .. F01B 7/14; F02B 15/00; F02B 53/02; F02B 75/24

USPC ..... 123/51 R

See application file for complete search history.

(56) References Cited

U.S. PATENT DOCUMENTS

| | | | | |
|---|---|---|---|---|
| 5,695,199 | A | 12/1997 | Rao et al. | |
| 10,060,386 | B2 | 8/2018 | Eismark | |
| 10,087,881 | B2 | 10/2018 | Miller et al. | |
| 2003/0213461 | A1* | 11/2003 | Regueiro | F02B 19/08 123/262 |
| 2016/0290224 | A1* | 10/2016 | Abani | F02B 23/066 |
| 2018/0128203 | A1* | 5/2018 | Koeberlein | F02B 75/282 |

* cited by examiner

*Primary Examiner* — Joseph J Dallo
*Assistant Examiner* — Yi-Kai Wang
(74) *Attorney, Agent, or Firm* — Terrance A. Meador; Julie J. Muyco

(57) ABSTRACT

A combination for an opposed-piston engine includes an intake piston and an exhaust piston, each with a top land height. The intake piston top land height is less than the exhaust piston top land height.

13 Claims, 5 Drawing Sheets

PISTON COMBINATIONS FOR OPPOSED-PISTON ENGINES

STATEMENT REGARDING FEDERALLY SPONSORED RESEARCH

This invention was made with government support under Award No.: DE-AR0000657 awarded by the Advanced Research Projects Agency-Energy (ARPA-E). The government has certain rights in the invention.

FIELD

The field of the invention relates to thermal management in an opposed-piston engine while optimizing combustion performance and minimizing toxic emissions. More specifically, the field relates to the construction of a pair of pistons that are oriented in opposition to each other in a cylinder of an engine when the engine is in use. The invention relates to a combination for an opposed-piston engine, which comprises two pistons which have different respective top land heights.

BACKGROUND

When compared to conventional "Vee" and straight-inline internal combustion engines with a single piston in each cylinder, it is known that opposed-piston engines possess fundamental architectural advantages in thermodynamics and combustion that deliver improvements in measures of engine performance. Nevertheless, uniflow-scavenged, opposed-piston engines characteristically have thermal requirements that are different from conventional engines that have one piston per cylinder. This difference in thermal requirements occurs in uniflow-scavenged opposed-piston engines because of the nature of charge air flow into and exhaust flow from the cylinders in these engines.

During scavenging in a uniflow-scavenged, opposed-piston engine, the predominant fluid flow is unidirectional, that is to say, charge air flows through the intake port of a cylinder and exhaust flows out of the cylinder's exhaust port. Because the air entering the cylinder is cooler than the exhaust, the exhaust portion of the cylinder and the piston that moves across the exhaust port (i.e., the exhaust piston), are exposed to greater heat and higher temperatures than the intake portion of the cylinder and the intake piston that moves across the intake port. Thus, the unidirectional flow of air and exhaust leads to exposure of the opposite ends of a cylinder to different temperature profiles. In uniflow-scavenged, two-stroke cycle, opposed-piston engines, there is less time for piston cooling between firing or combustion events, so the difference in thermal environments that the exhaust and intake pistons are exposed to is even more pronounced. Thus, each end of a cylinder (e.g., intake end and exhaust end) and the pistons associated with the respective ends can have different structural, fabrication, and materials requirements for the engine as a whole to operate for a given lifetime.

Balancing the need for durability of an opposed-piston engine and its components with engine efficiency and minimization of toxic emissions is another factor in engine component design. With respect to the construction of pistons for each cylinder of an opposed-piston engine, one design factor concerns the circumferential region between the end surface of the piston crown and the closest ring groove, which is referred to as the "top land" of the piston. According to the invention, the distance between the end surface of the piston crown and the closest ring groove (i.e., the "top land height") will be different for one piston than for the other. That is to say, the top land height of the exhaust piston will be different from the top land height of the intake piston. For example, the top land height of the exhaust piston may be be greater on the exhaust piston than on the intake piston in a particular exhaust/intake piston combination.

SUMMARY

A combination (or set) of two pistons for a uniflow-scavenged, opposed-piston engine is provided. The combination (also called a "pair") includes features for adapting the pistons to variations in thermal conditions between an intake end and an exhaust end of a cylinder of the opposed-piston engine in which the pistons may be disposed.

A uniflow scavenged opposed-piston engine includes at least one cylinder with a pair of pistons that includes an intake piston and an exhaust piston, in which the top land height of the exhaust piston is greater than that of the intake piston. Instead of both pistons having the same top land height distance (e.g., the distance from the crown end surface to the top-most ring groove), the top land height of the intake piston is reduced to reflect the relatively milder temperature experienced by the intake side of an uniflow-scavenged, opposed-piston engine, including the intake piston. Because a piston sidewall is not designed to be in complete and continuous contact with a cylinder bore surface, an annular crevice is defined between the piston sidewall and cylinder bore surface, the depth of which is determined by the top land height of a piston.

The reason the crevice depth is determined by a piston's top land height is because a compression ring seated in the ring groove adjacent the top land is designed to be in nearly constant contact with the cylinder bore surface. The volume of the crevice between a piston and a cylinder bore surface may be optimized to reduce the amount of fuel not consumed during combustion.

The piston combinations or pairs described herein reduce the overall volume associated with the crevices formed between the piston top lands and the bore surface by optimizing the top land heights on each piston independently.

DETAILED DESCRIPTION OF THE PREFERRED EMBODIMENTS

Pistons for an opposed-piston engine are described herein. Typically an opposed-piston engine includes at least one cylinder in which an intake port is formed in a first region of the cylinder that extends to a first end of the cylinder and an exhaust port is formed in a second region that extends to a second end of the cylinder opposite the first end. Two pistons are disposed in mutual opposition in the cylinder for sliding motion along the cylinder's bore. One piston moves to and fro in the first region, across the intake port; this piston is denoted as an "intake piston". The other piston moves to and fro in the second region, across the exhaust port; this piston is denoted as an "exhaust piston". According to the invention, the intake and exhaust pistons are constructed to operate in a combination which can reduce the toxic emissions and enhance the efficiency of the engine. As per the following detailed description, the intake piston and the exhaust piston of the piston pair have different configurations that make allowances for the differences in temperature and pressure profiles experienced by each piston. An opposed-piston engine with such a piston combination is also described.

Figure 1:
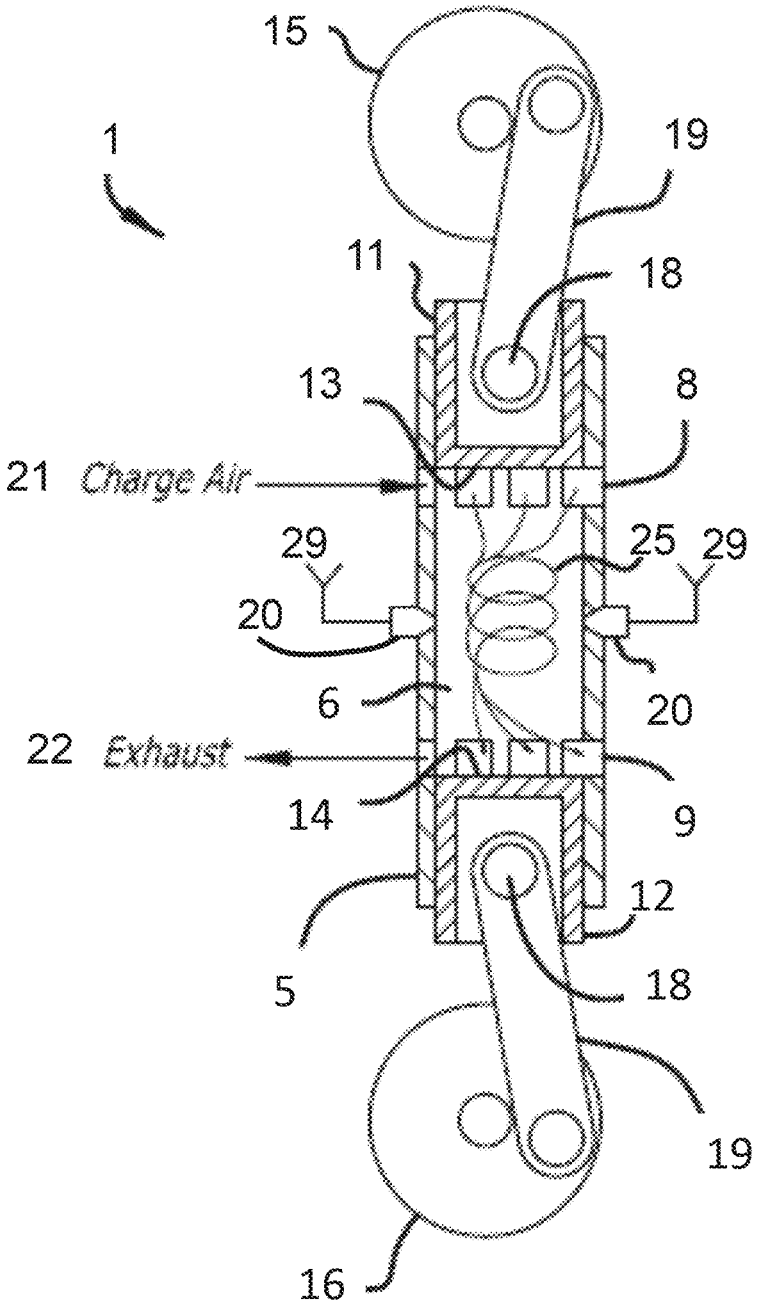
FIG. 1 (PRIOR ART)
FIG. 1 shows a schematic drawing of an opposed-piston engine, and is properly labeled "Prior Art".

In FIG. 1 a two-stroke cycle, opposed-piston engine 1 is shown as an example of an internal combustion engine of the opposed-piston type with which the invention may be used. The engine 1 includes at least one ported cylinder 5. The engine 1 may have one ported cylinder, two ported cylinders, three ported cylinders, or four or more ported cylinders; all possibilities are represented by the cylinder 5. The cylinder 5 includes a bore 6 and longitudinally displaced intake and exhaust ports 8 and 9, machined or formed in a sidewall of the cylinder near respective ends thereof. Each of the exhaust and intake ports includes one or more circumferential arrays of openings in which adjacent openings are separated by a solid portion of the cylinder sidewall. In some descriptions, each opening may be referred to as a "port"; however, the construction of a circumferential array of such "ports" is no different than the port constructions shown in FIG. 1.

One or more injection nozzles 20 are positioned in holes that open through the sidewall of the cylinder 5, between the intake and exhaust ports 8 and 9. Two pistons 11, 12 are slidably disposed in the bore 6 of the cylinder with their end surfaces 13 and 14 in opposition to each other. For convenience, the piston 11 is referred to as the "intake" piston because of its proximity to, and control of, the intake port 8. Similarly, the piston 12 is referred to as the "exhaust" piston because of its proximity to, and control of, the exhaust port 9. The engine includes two rotatable crankshafts 15 and 16 that are disposed in a generally parallel relationship and positioned outside of respective intake and exhaust ends of the cylinder. The intake piston 11 is coupled to the crankshaft 15 (referred to as the "intake crankshaft"), which is disposed along an intake end of the engine 1 where cylinder intake ports are positioned; and, the exhaust piston 12 is coupled to the crankshaft 16 (referred to as the "exhaust crankshaft"), which is disposed along an exhaust end of the engine 1 where cylinder exhaust ports are positioned. In uniflow-scavenged, opposed-piston engines with two or more cylinders, all exhaust pistons are coupled to the exhaust crankshaft 16 and all intake pistons to the intake crankshaft 15.

Each of the pistons 11 and 12 is coupled to its associated crankshaft by a wrist pin 18 and a connecting rod 19. When the pistons 11 and 12 of a cylinder 5 are at or near respective top center locations (e.g., top dead center equivalent locations or minimum volume locations), a combustion chamber is defined in the bore 6 between the end surfaces 13 and 14 of the pistons. Fuel is injected directly into the combustion chamber through at least one fuel injector nozzle 20.

Operation of the opposed-piston engine 1 is well understood. Each of the pistons 11, 12 reciprocates in the bore 6 between a bottom center (BC) position near a respective end of the cylinder 5 where the piston is at its outermost position with respect to the cylinder, and a top center (TC) position where the piston is at its innermost position with respect to the cylinder. At the bottom center position, the piston's end surface is positioned between a respective end of the cylinder, and its associated port, which opens the port for the passage of gas. As the piston moves away from bottom center, toward the top center position, the port is closed. During a compression stroke each piston moves through the bore 6, away from BC, toward its TC position. As the pistons approach their TC positions, air is compressed in a combustion chamber formed between the end surfaces of the pistons. Fuel is injected into the combustion chamber. In response to the pressure and temperature of the compressed air, the fuel ignites and combustion follows, driving the pistons apart in a power stroke. During a power stroke, the opposed pistons move away from their respective TC positions. While moving from TC, the pistons keep their associated ports closed until they approach their respective BC positions.

The pistons may move in phase so that the intake and exhaust ports 8 and 9 open and close in unison, in some instances. However, one piston may lead the other in phase, in which case the intake and exhaust ports have different opening and closing times. In such cases, the combustion chamber may be formed when the pistons in a cylinder achieve minimum volume; that is to say when the piston crown end surfaces are closest together. Minimum volume may occur when one or both pistons in a cylinder are not at TC position.

In some instances, a phase difference is introduced in piston movements to drive the process of uniflow scavenging in which pressurized charge air 21 entering a cylinder 5 through the intake port 8 pushes the products of combustion (exhaust gas) 22 out of the cylinder 5 through the exhaust port 9. The replacement of exhaust gas 22 by charge air 21 in the cylinder 5 is "scavenging." The scavenging process is uniflow because gas movement through the cylinder 5 is in one direction: intake-to-exhaust. In order to optimize the uniflow scavenging process, the movement of the exhaust piston 12 may be advanced with respect to the movement of the intake piston 11. In this respect, the exhaust piston 12 is said to "lead" the intake piston 11 in phase. Thus, exhaust gas 22 flows out of the cylinder 5 before inflow of pressurized charge air 21 begins (this interval is referred to as "blow down"), and pressurized charge air continues to flow into the cylinder after the outflow of exhaust gas ceases. Between these events, both ports are open (this is when scavenging occurs). Scavenging ends when the exhaust port 9 closes. Now, having no exit, the scavenging charge air 25 continues to flow into the cylinder 5 between time of closure of the exhaust port 9 and the time of closure of the intake port 8, is caught in the cylinder 5, and is retained therein when the intake port 8 closes. This retained portion of charge air retained in the cylinder by the last port closure is referred to as "trapped air", and it is this trapped air that is compressed during the compression stroke.

Figure 2:
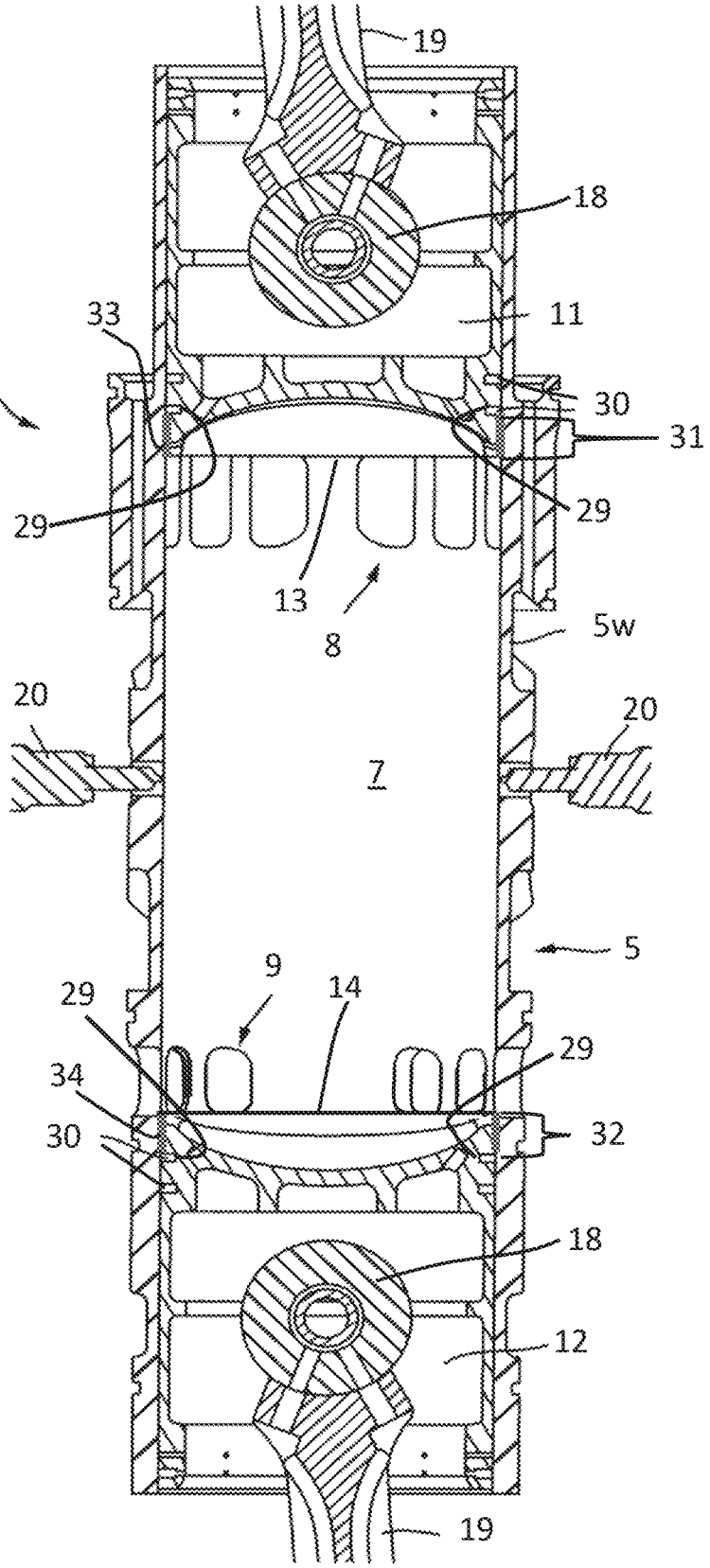
FIG. 2 (PRIOR ART)
FIG. 2 is a longitudinal cross-sectional view taken through a cylinder of an opposed-piston engine constructed for two stroke-cycle operation, and is properly labeled "Prior Art".

FIG. 2 shows a closer view of a pair of pistons 11 and 12 in a cylinder 5 in an opposed-piston engine 1. The pistons 11 and 12 are shown with the small ends of their connecting rods 19 attached to wrist pins 18 in the skirt portion of each piston. The cross-sectional view of the engine shows a cylinder 5 with a sidewall 5*w*, the inner portion of which defines the cylinder bore. The cylinder bore has a surface 7.

Each piston 11, 12, has one or more ring grooves within which a compression ring is tensioned to contact the bore surface 7 as the pistons move in the cylinder is inserted into each ring groove. The pistons 11, 12 shown in FIG. 2 each have a portion of the piston crown extending from the end surface 13, 14 to a ring groove 29; this portion of the piston crown is the top land 31, 32. Between the top land 31, 32 of each piston and the bore surface 7 is a crevice 33, 34. Specifically, the intake piston 11 has a top land 31 that, with the cylinder bore surface 7, creates an intake piston top land crevice 33, which is generally annular in shape. Correspondingly, the exhaust piston 12 has a top land 32 and an exhaust piston top land crevice 34 which is generally annular in shape.

In an internal combustion engine, the top land height of a piston, and the corresponding crevice volume between the piston top land and bore surface, may be minimized to maximize the amount of trapped charge air available for combustion while also minimizing the heat reaching the top-most ring groove. In the engine shown in FIG. 2, fuel from injectors 20 mixes with trapped charge in preparation for combustion. However, air in the crevice between the piston top land and bore wall 7 interacts in a limited fashion, if at all, with injected fuel. In engines that utilize premixed or partially premixed fuel and charge air, any fuel mixed with air in the crevice does not participate in combustion. Unburned fuel passes out of the cylinder with the exhaust gas as emitted hydrocarbons and can reduce combustion efficiency by several percent. Thus, minimizing the crevice volume minimizes the amount of unburned fuel, increases combustion efficiency, and improves emissions performance.

The crevice between a piston's top land and the cylinder's bore surface also serves as a leak path between a cylinder's interior and the port past which the piston passes during engine operation. That is to say, the crevice allows for fluid communication from the interior of a cylinder to an intake or exhaust plenum connected to the ports until the compression rings have passed completely past the ports as the pistons move toward top center locations. Charge air that leaks out as pistons move from bottom center positions to minimum volume positions reduces the trapped air mass. Minimizing the crevice volume minimizes charge air leakage.

Figure 3C:
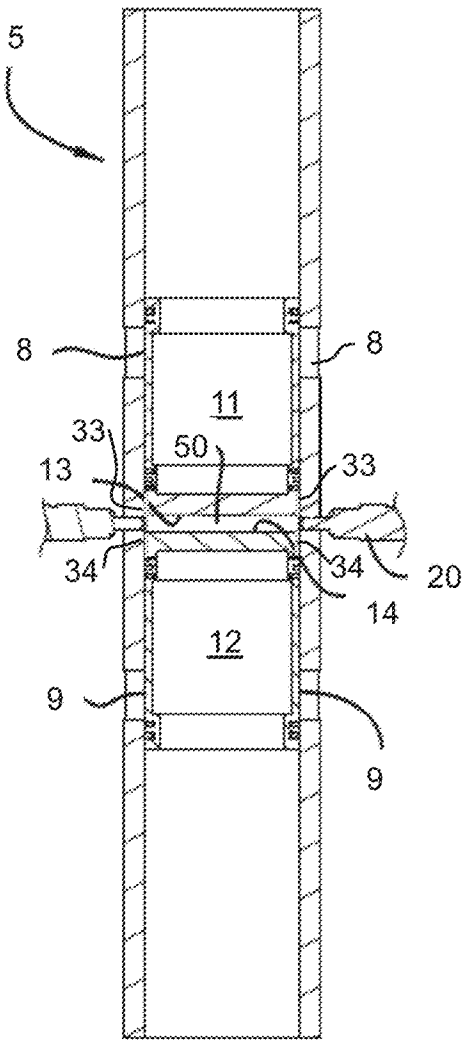
(PRIOR ART) FIG. 3C
FIGS. 3A, 3B, and 3C show a cross-sectional view of an exemplary pair of pistons in an uniflow scavenged opposed-piston engine at various points in the combustion cycle, and is properly labeled "Prior Art".
Figure 3B:
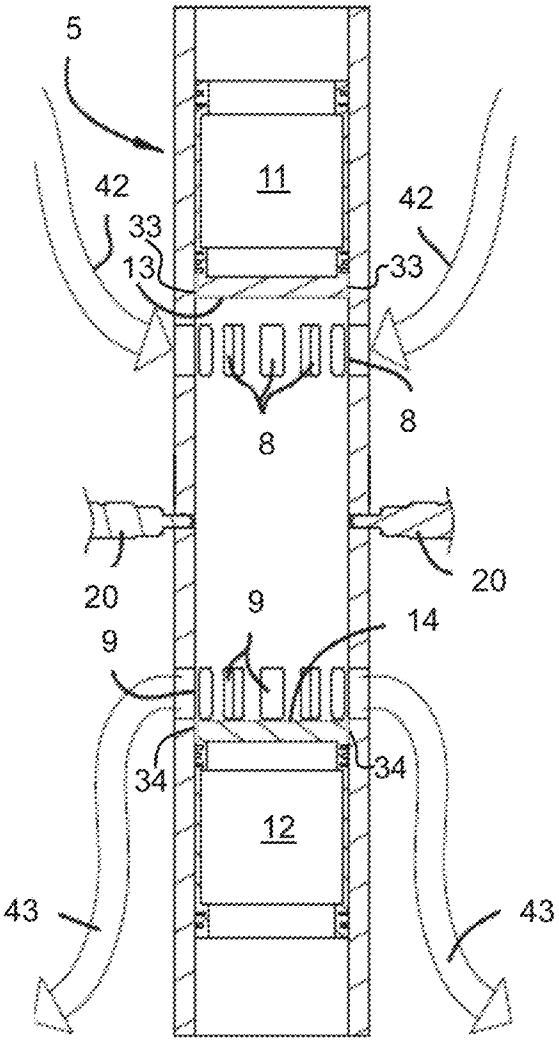
(PRIOR ART) FIG. 3B
Figure 3A:
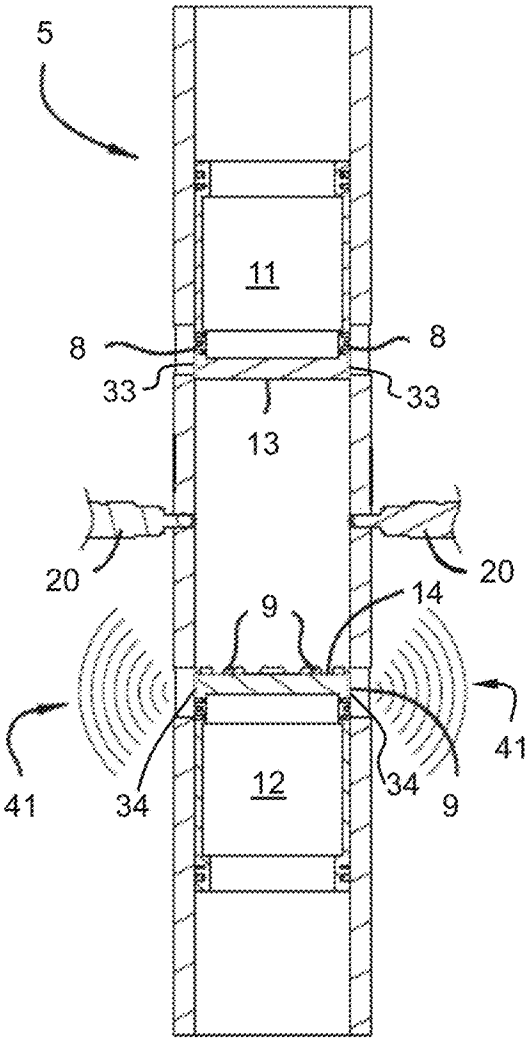
(PRIOR ART) FIG. 3A

FIGS. 3A-3C show a representative pair of pistons at various positions during a combustion cycle. FIG. 3A shows a cylinder undergoing blowdown. The cylinder shown in FIG. 3A is at the end of a combustion stroke, with an exhaust pressure pulse 41 emanating from the exhaust port 9. FIG. 3B shows a cylinder during scavenging. Charge air mass 42 is shown entering the intake port 8 and exhaust mass 43 is seen exiting the exhaust port 9. FIG. 3C shows a pair of pistons at minimum volume positions (e.g., top center positions), with a combustion chamber 50 between the piston end surfaces 13, 14.

Figure 4:
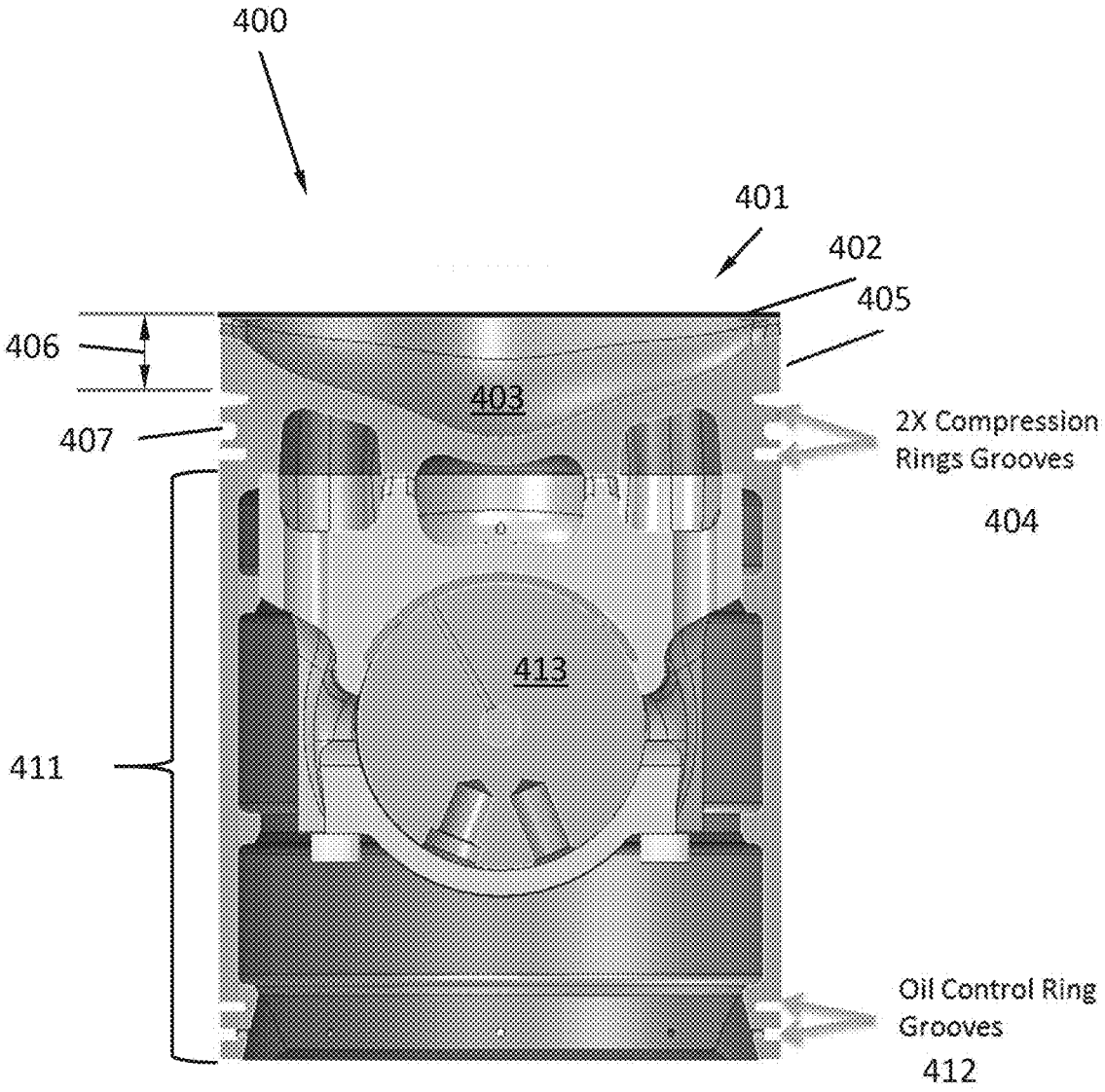
(PRIOR ART) FIG. 4
FIG. 4 is a cross-sectional view of an exemplary prior art piston for a uniflow scavenged opposed-piston engine.

FIG. 4 shows a representative prior art piston that is part of a pair of pistons in which both pistons have the same structure. The piston 400 has a crown portion 401, a skirt portion 411, and is shown with a wrist pin 413 that connects the piston 400 to a connecting rod (not shown). The skirt portion 411 primarily consists of a sidewall that that connects to the crown 401 at one end and is open at its opposite end. In a region of the sidewall, adjacent the open end of the skirt portion 411, are ring grooves 412 in a ring pack. Oil control rings, which may include an oil scraper ring, are seated in this set of ring grooves 412 when the piston is installed in an engine cylinder. The oil control rings allow for lubricating oil to be used in the system without an excessive amount being burned during combustion by preventing the majority of lubricating oil from reaching the combustion chamber. The piston crown 401 includes an end surface 402 having a peripheral edge where the end surface meets the piston sidewall. The crown 401 also includes a bowl 403 that is part of the end surface 402. In an opposed-piston engine, the end surfaces of two pistons meet near the center of a cylinder to define, along with portions of the cylinder bore surface, a combustion chamber. The crown 401 has ring grooves 404 in a ring pack in the piston side wall. In use, the ring grooves 404 accommodate piston rings that help to contain fuel and charge air in the combustion chamber prior to combustion, as well as to prevent blow-by of the products of combustion. As seen in FIG. 4, a piston crown may include more than one groove for a compression ring, as well as a groove for an oil spreading ring 407. The compression rings contact the cylinder bore surface when the piston is installed in an engine cylinder. The top land 405 extends from the top-most ring groove 404 to the end surface 402. The top land height 406 for both pistons in the pair is the same. In this pair, the top land height is optimized for the harshest temperatures encountered by the pistons, those on the exhaust end of the engine cylinder. Thus, the thermal requirements of the exhaust piston indicate the top land heights of both pistons.

Figures 5A, 5B:
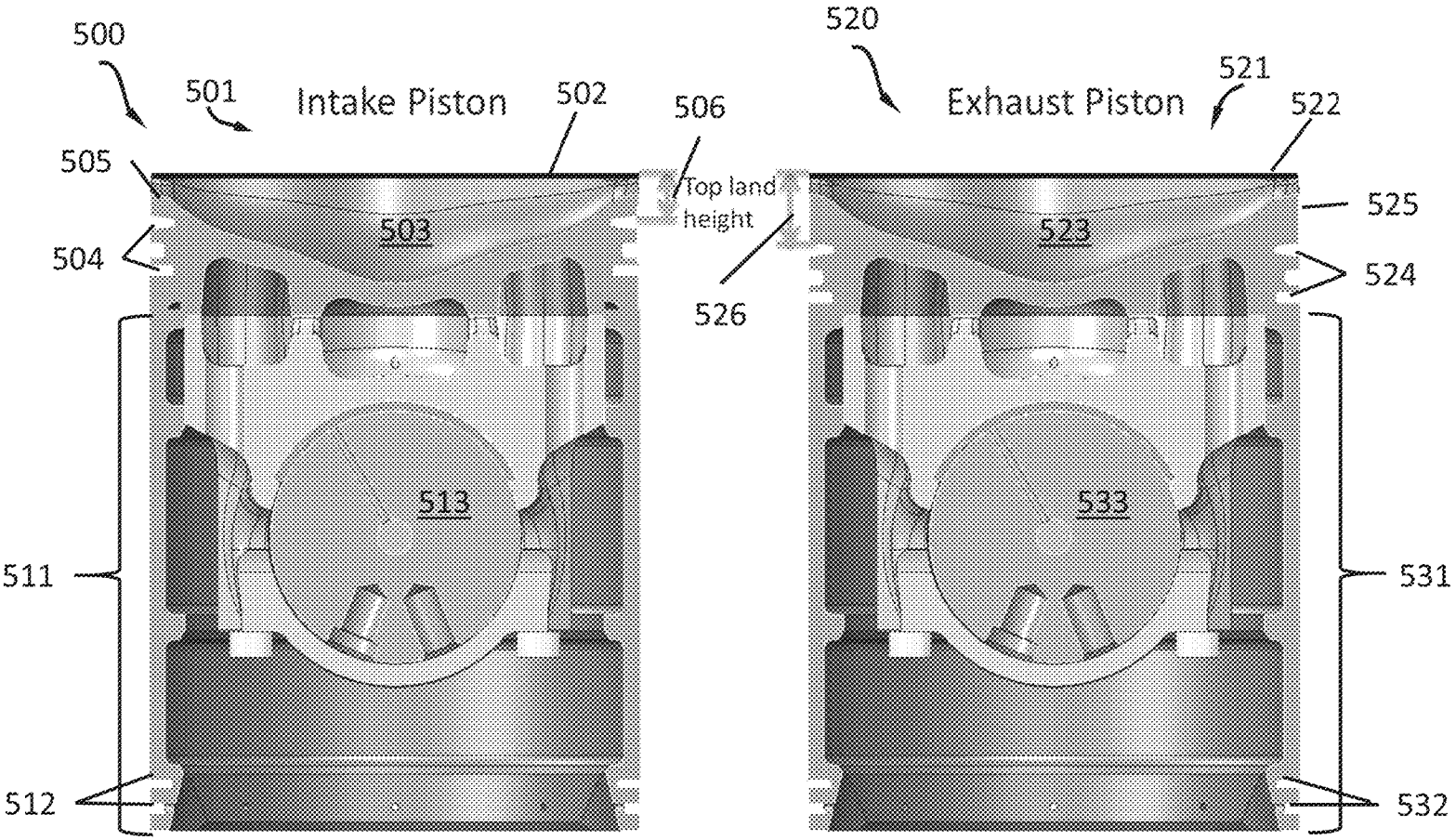
FIGS. 5A and 5B shows an exemplary pair of pistons for use with an opposed-piston engine according to the invention.

FIGS. 5A and 5B together show a pair of pistons in which the intake piston and exhaust piston have different top land heights. FIG. 5A shows an intake piston 500, while FIG. 5B shows an exhaust piston 520. The intake piston 500 comprises a first crown 501 with a first end surface 502, and a first piston bowl 503 in the first piston crown 501. The exhaust piston 520 comprises a second crown 521 with a second end surface 522, and a second piston bowl 523 in the second piston crown 521. The intake piston comprises a top land 505 having a first top land height 506, and the exhaust piston 520 comprises a top land 525 having a second top land height 526, in which the first height 506 is less than the second height 526. The difference in the top land height between the intake and exhaust piston reduces the leak path and the volume of trapped charge air/charge fluid (e.g., gas and air mixture) when the piston pair is installed in a cylinder. Additionally, the top land height difference can allow for similar thermal conditions for the top-most ring in each piston of the piston pair while an engine is in use. Thus, the top land height 506 on the intake piston is such that the top-most ring groove 504 is closer to the intake piston's end surface 502 than that of the exhaust piston 520. Because the exhaust piston 520 is exposed to exhaust gas following combustion (e.g., during scavenging), while the intake piston 500 is exposed to relatively cool charge air, the top land height 526 of the exhaust piston 520 is greater; the top-most ring groove 524 is further away from the end surface 522 in the exhaust piston as compared to the intake piston 500. If the materials of both piston crowns in a pair of pistons have substantially same heat capacity (e.g., are made from the same materials), then the greater mass between the end surface and the top-most ring groove in the exhaust piston may prevent exposing the top-most piston ring to excessive heat. This would allow for using the same piston rings in both the intake and exhaust pistons, while minimizing the crevice volume on the intake piston side of the engine to optimize engine performance in terms of emissions (e.g., reducing unburned fuel, minimizing leakage of charge air).

In piston pairs for use in an opposed-piston engine as described herein, the intake piston top land height is less than the exhaust piston top land height, so that a ratio between the intake piston top land height and exhaust piston top land height is within a range of 1.0:1.45 to 1.0:2.0. In a preferred embodiment, the ratio of the intake piston top land height to the exhaust piston top land height is 1.0:1.8. Alternatively, the ratio of the intake piston top land height to the exhaust piston top land height is 1.0:1.67; further, the ratio of top land heights can be 1.0:2.0 in a pair of pistons where the exhaust piston has a greater top land height. The relationship between the top land heights in a pair of pistons can depend upon the range of temperatures, or the average temperature, experienced by each piston, as well as the specific heat of the material of each piston crown. Particularly when the intake piston includes different materials from those used to construct the exhaust piston, the specific heats of the materials used to fabricate the intake and exhaust piston, specifically the piston crown materials, can greatly influence the ratio between the intake piston top land height and that of the exhaust piston. In an engine, in a piston pair as described herein with different top land heights on the intake piston and the exhaust piston, during use a temperature in at least one ring groove of a set of ring grooves, located in the crown portion of the piston, in the intake piston can be about the same as a temperature in at least one ring groove of a set of ring grooves in the exhaust piston. The difference in top land height in the two pistons in the piston pair allows for at least the top-most ring groove in each piston of the pair to have approximately the same temperature (e.g., within 5° C. to 10° C.) while the engine is in use; correspondingly, piston rings made of the same material in the top-most ring groove of each piston should be approximately the same temperature (e.g., within 5° C. to 10° C.) when the piston pair is installed in an internal combustion engine.

Though the figures show pistons with ring grooves sets (i.e., ring packs; ring belts) that include two ring grooves (typically, although not necessarily allocated for compression rings) surrounding a third ring groove (typically, although not necessarily allocated for an oil spreader ring), a piston, or pistons in a piston combination or set, as described herein may have one, two, or three or more ring grooves for any particular design. Further, the piston crowns shown in the figures illustrate piston bowls and end surfaces of a particular configuration. However, the piston end surfaces of the invention may vary from those shown, and in a pair of pistons, as described herein, the intake piston end surface can have a different shape from the exhaust piston end surface, such that the intake and exhaust pistons have different bowl shapes. In some implementations, the piston bowls can create an asymmetrically-shaped combustion chamber when the intake and exhaust pistons are at their respective minimum volume locations when an opposed-piston engine is in use. Additionally, or alternatively, in some implementations, the piston bowls can create a combustion chamber with point symmetry about a center point of the combustion chamber when the intake and exhaust pistons are at minimum volume locations.

The scope of patent protection afforded the novel apparatus, systems, and methods described and illustrated herein may suitably comprise, consist of, or consist essentially of a pair of pistons for use in a uniflow scavenged opposed-piston engine in which the piston pair includes features adapted to variations in thermal conditions between an intake end and an exhaust end of a cylinder in the opposed-piston engine, which is provided in some implementations. Further, the novel apparatus, systems, and methods disclosed and illustrated herein may suitably be practiced in the absence of any element or step which is not specifically disclosed in the specification, illustrated in the drawings, and/or exemplified in the embodiments of this application. Moreover, although the invention has been described with reference to the presently preferred embodiment, it should be understood that various modifications can be made without departing from the spirit of the invention. Accordingly, the invention is limited only by the following claims.

What is claimed is:

1. An opposed-piston internal combustion engine, comprising:

an intake piston comprising:

a first crown with a first end surface;

a first set of ring grooves comprising at least one ring groove separated from the first end surface by a first top land height; and a first piston bowl in the first piston crown; and an exhaust piston disposed in opposition to the intake piston, the exhaust piston comprising:

a second crown with a second end surface;

a second set of ring grooves comprising at least one ring groove separated from the second end surface by a second top land height; and a second piston bowl in the second piston crown, in which the first top land height is less than the second top land height.

2. The opposed-piston engine of claim 1, further comprising a cylinder in which the intake and exhaust pistons are situated in an opposing manner, such that a combustion chamber is formed between the first piston bowl and the second piston bowl when the pistons are at or near top center locations in the cylinder.

3. The opposed-piston engine of claim 2, wherein, during operation of the engine:

the intake piston moves across intake port openings of an intake port in the cylinder to open and close the intake port; and the exhaust piston moves across exhaust port openings of an exhaust port in the cylinder to open and close the exhaust port.

4. The opposed-piston engine of claim 1, wherein a ratio of the first top land height to the second top land height is 1.0:2.0.

5. The opposed-piston engine of claim 1, wherein a ratio of the first top land height to the second top land height is 1.0:1.8.

6. The opposed-piston engine of claim 1, wherein a ratio of the first top land height to the second top land height is 1.0:1.67.

7. The opposed-piston engine of claim 1, wherein a ratio of the first top land height to the second top land height is within a range of 1.0:1.45 to 1.0:2.0.

8. The opposed-piston engine of claim 1, wherein:

the first piston bowl differs from the second piston bowl such that the first and second piston bowls create an asymmetrically-shaped combustion chamber when the intake and exhaust pistons are at minimum volume locations when the opposed-piston engine is in use.

9. A piston combination for an opposed-piston engine, the piston combination comprising an intake piston comprising a top land having a first height, and an exhaust piston comprising a top land having a second height, in which the first height is less than the second height.

10. The piston combination of claim 9, wherein a ratio of the first height to the second height is 1.0:2.0.

11. The piston combination of claim 9, wherein a ratio of the first height to the second height is 1.0:1.8.

12. The piston combination of claim 9, wherein a ratio of the first height to the second height is 1.0:1.67.

13. The piston combination of claim 9, wherein a ratio of the first height to the second height is within a range of 1.0:1.45 to 1.0:2.0.

* * * * *